US012290186B2

(12) United States Patent
Lennon

(10) Patent No.: US 12,290,186 B2
(45) Date of Patent: May 6, 2025

(54) REFRIGERATED MERCHANDISING CABINET

(71) Applicant: Orrell Limited, Dublin (IE)

(72) Inventor: Eoin Lennon, Clane (IE)

( * ) Notice: Subject to any disclaimer, the term of this patent is extended or adjusted under 35 U.S.C. 154(b) by 0 days.

(21) Appl. No.: 18/860,834

(22) PCT Filed: May 2, 2023

(86) PCT No.: PCT/EP2023/061516

§ 371 (c)(1),
(2) Date: Oct. 28, 2024

(87) PCT Pub. No.: WO2023/209248

PCT Pub. Date: Nov. 2, 2023

(65) Prior Publication Data

US 2025/0107641 A1 Apr. 3, 2025

(30) Foreign Application Priority Data

Apr. 29, 2022 (IE) ..... 2022/0076

(51) Int. Cl.
*A47F 3/04* (2006.01)

(52) U.S. Cl.
CPC ..... *A47F 3/0408* (2013.01); *A47F 3/0434* (2013.01)

(58) Field of Classification Search
CPC ..... A47F 3/0408; A47F 3/043; A47F 3/0434; A47F 3/0452; A47F 3/0456
See application file for complete search history.

(56) References Cited

U.S. PATENT DOCUMENTS 4,977,754 A * 12/1990 Upton ..... A47F 3/0408 62/277
5,606,863 A * 3/1997 Kicklighter ..... A47F 3/0413 62/89

(Continued)

FOREIGN PATENT DOCUMENTS

CN 217610305 U 10/2022
KR 20220023588 A * 3/2022

(Continued)

OTHER PUBLICATIONS

Yu, KR20220023588 and translation (Year: 2022).*

(Continued)

*Primary Examiner* — Steven S Anderson, II
(74) *Attorney, Agent, or Firm* — Michael Crilly, Esquire

(57) ABSTRACT

A refrigerated merchandising cabinet is presented including an upright insulated housing having an interior which forms a cold storage chamber. The housing is open-fronted having a front access opening closed by a plurality of juxtaposed hinged access doors. An interior of the cold storage chamber is sub-divided into three separate cooling compartments by two upstanding internal divider panels. Three refrigeration modules are mounted in a row on top of the housing and are operable to circulate chilling air in a controlled manner through the cold storage chamber for chilling or freezing product for sale stored within the cold storage chamber. Each refrigeration module is associated with one of the cooling compartments and operates independently of the other refrigeration modules in response to sensed climate conditions within the associated cooling compartment.

15 Claims, 7 Drawing Sheets

(56) References Cited

U.S. PATENT DOCUMENTS

| | | | | |
|---|---|---|---|---|
| 6,675,588 | B2 * | 1/2004 | Rudick | A47F 3/0408 62/6 |
| 8,104,302 | B2 * | 1/2012 | Hayase | A47F 3/0426 62/279 |
| 2015/0059387 | A1 * | 3/2015 | Hierlmeier | A47F 3/0408 62/255 |

FOREIGN PATENT DOCUMENTS

| | | | | |
|---|---|---|---|---|
| RU | 197434 | U1 | 4/2020 | |
| RU | 205617 | U1 | 7/2021 | |
| WO | WO-2022066935 | A2 * | 3/2022 | A47F 3/0408 |

OTHER PUBLICATIONS

International Search Report for PCT/EP2023/061516, European Patent Office, Completed Aug. 10, 2023 (3 pages).
Written Opinion of the International Searching Authority for PCT/EP2023/061516, European Patent Office, Completed Aug. 10, 2023 (6 pages).
Search Report and Written Opinion for IE2022/0076, Irish Patent Office, Completed Jan. 24, 2023 (3 pages).

* cited by examiner

REFRIGERATED MERCHANDISING CABINET

REFERENCE TO RELATED APPLICATIONS

This application is a national phase to PCT Application No. PCT/EP2023/061516 filed May 2, 2023 which in turn claims priority to Irish Patent Application No. 2022/0076 filed Apr. 29, 2022, wherein each said application is entitled Refrigerated Merchandising Cabinet and all said applications are incorporated in their entirety herein by reference thereto.

FEDERALLY SPONSORED RESEARCH AND DEVELOPMENT

None.

FIELD OF THE INVENTION

This invention relates to a refrigerated merchandising cabinet, and in particular to cabinets for the storage and display of chilled and frozen products for sale in a retail outlet.

BACKGROUND OF THE INVENTION

In a previous patent application, Publication No. EP 3785574 A1, we have disclosed a refrigerated merchandising cabinet, comprising an upright insulated housing forming a cold storage chamber, the housing having a rectangular base with upstanding side walls comprising end walls at each side of the base and a rear wall at a rear of the base, and a top wall at a top of the side walls, the base, side walls and top wall defining the cold storage chamber having a front access opening, the front access opening closed by at least two access doors, each access door having a transparent window for viewing product stored within the storage chamber, at least two refrigeration modules mounted spaced-apart on top of the top wall, each refrigeration module having a cold air outlet connected to cooling air inlets of the cold storage chamber and a return air inlet connected to an associated cooling air outlet of the cold storage chamber.

The present invention is directed to various developments and improvements in this type of refrigerated merchandising cabinet.

SUMMARY OF THE INVENTION

According to the invention, there is provided a refrigerated merchandising cabinet comprising: an upright insulated housing forming a cold storage chamber, the housing has a rectangular base with upstanding side walls comprising end walls at each side of the base and a rear wall at a rear of the base, and a top wall at a top of the side walls, the base, side walls and top wall define the cold storage chamber having a front access opening, the front access opening is closed by at least two access doors, each access door has a transparent window for viewing product stored within the storage chamber; at least two refrigeration modules are mounted spaced-apart on top of the top wall, each refrigeration module has a cold air outlet connected to cooling air inlets of the cold storage chamber and a return air inlet connected to an associated cooling air outlet of the cold storage chamber; and a cold air duct formed within the rear wall of the housing has a plurality of vertically spaced-apart air outlets for discharging cold air into the cold storage chamber directed towards the access doors at the front of the cold storage chamber for subsequent delivery of air up along an inside face of each access door to the cooling air outlets at the top wall of the cold storage chamber, the cold air duct communicates through a cold air transfer duct in the base with an air distribution manifold mounted at a front of the base and has an outlet to direct an airstream upwardly along inside faces of the access doors.

In a preferred embodiment, at least one upright divider panel is mounted within the cold storage chamber substantially parallel to and spaced-apart from the end walls to divide the cold storage chamber into at least two separate cooling compartments, and each cooling compartment has its own refrigeration module mounted at a top of the cooling compartment.

In another embodiment, each cooling compartment has a separate refrigeration module and associated cold air duct, cold air transfer duct, and air distribution manifold.

In another embodiment, two divider panels are mounted spaced-apart within the cold storage chamber to divide the cold storage chamber into three separate cooling compartments.

In another embodiment, each refrigeration module operates independently of the other refrigeration modules in response to sensed climate conditions within the associated cooling compartment.

In another embodiment, each refrigeration module is operable to control the cooling air speed to limit air turbulence at an inside face of the access doors In another embodiment, the air outlets comprise a plurality of vertically spaced-apart rows of horizontally spaced-apart air outlet ports.

In another embodiment, each cooling air outlet of the cold storage chamber comprises an outlet manifold on an inside face of the top wall of the housing.

In another embodiment, each manifold has a bottom panel spaced downwardly from the inside face of the top wall, the bottom panel extends between the end walls and extends outwardly from an inner face of the rear side wall of the housing towards the access doors and has a perforated front panel extending downwardly from the inside face of the top wall of the housing to the bottom panel and spaced inwardly of the access door.

In another embodiment, the perforated front panel is inclined, being angled outwardly and downwardly of the inside face of the top wall.

In another embodiment, the manifold has an inclined rear panel aligned with the associated rear cold air outlet in the top wall and extending between the cold air outlet and an inlet of the cold air duct in the rear side wall of the housing to funnel cold air from the evaporator into the cold air duct.

In another embodiment, the divider panel comprises a transparent panel.

In another embodiment, the divider panel comprises a stiff plastics material.

In another embodiment, the divider panel comprises acrylic material.

In another embodiment, at least one divider panel is an insulated panel.

BRIEF DESCRIPTION OF THE DRAWINGS

The invention will be more clearly understood by the following description of some embodiments thereof, given by way of example only, with reference to the accompanying drawings.

DETAILED DESCRIPTION

Figure 8:
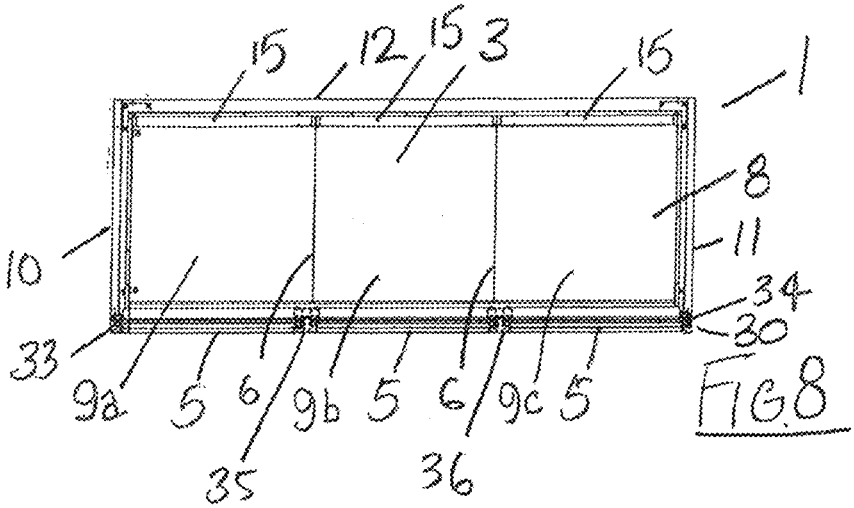
FIG. 8 is a sectional plan view of the refrigerated merchandising cabinet.
Figure 9:
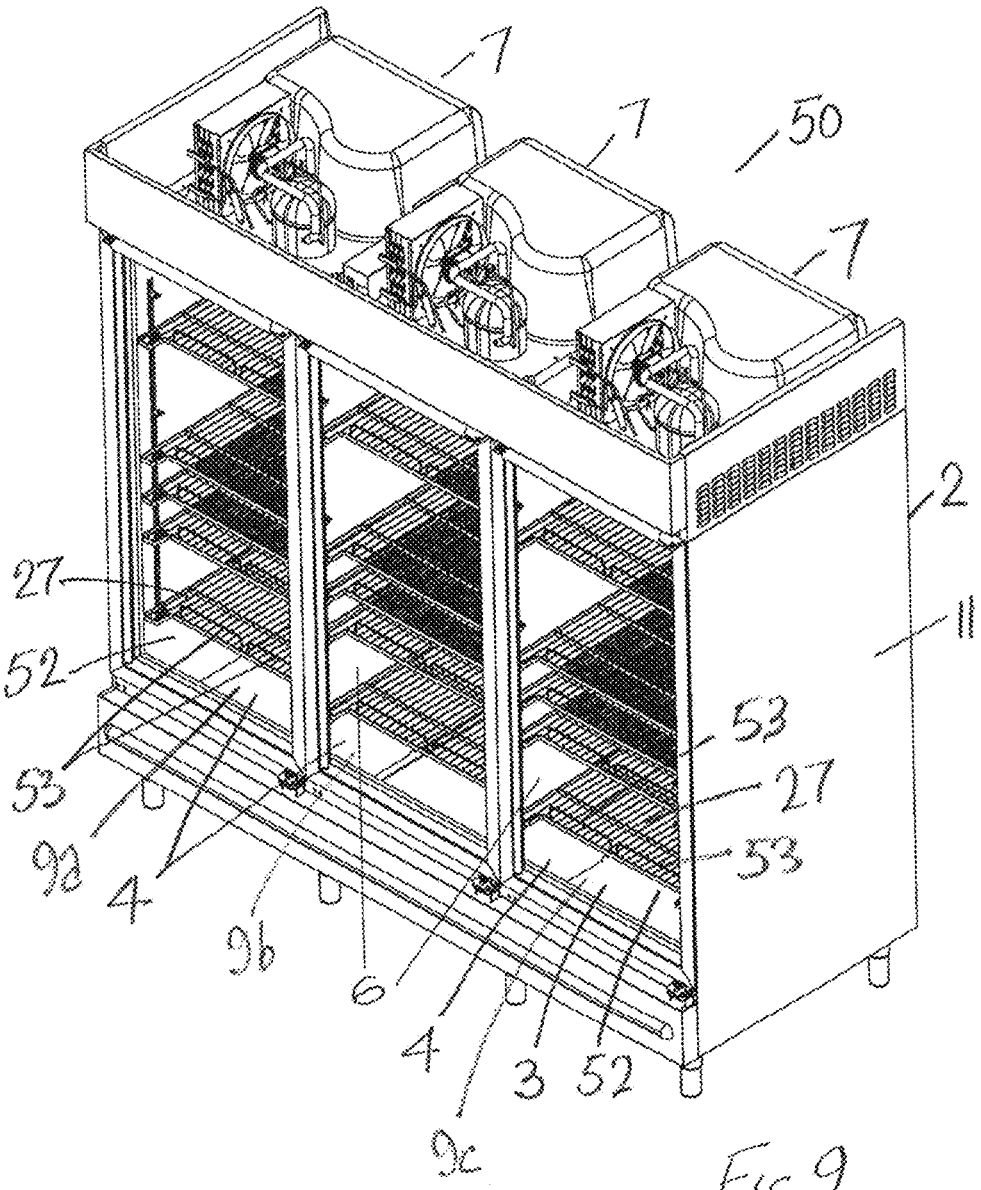
FIG. 9 is a perspective view of a refrigerated merchandising cabinet according to another embodiment of the invention.
Figure 10:
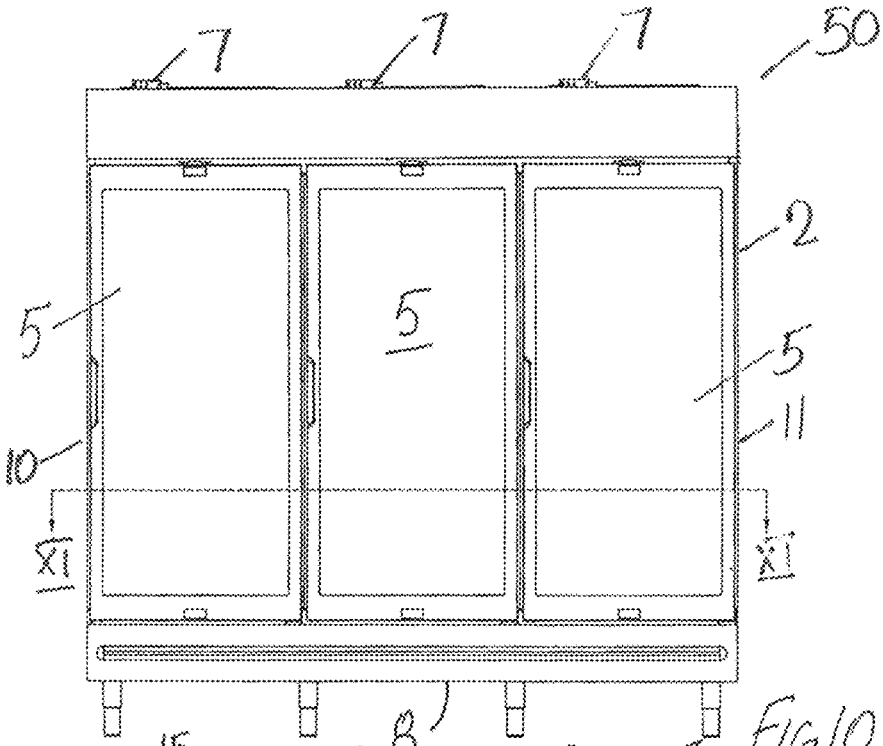
FIG. 10 is a front elevational view of the refrigerated merchandising cabinet shown in FIG. 9.
Figure 11:
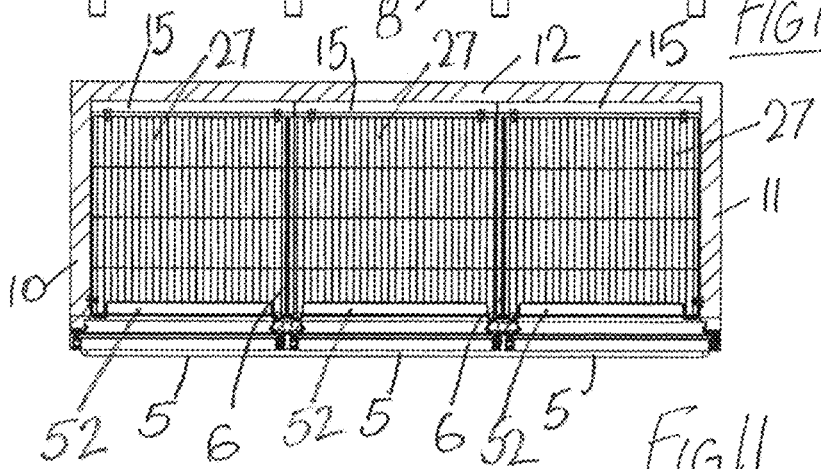
FIG. 11 is a sectional view taken along the line XI-XI of FIG. 10.
Figure 12:
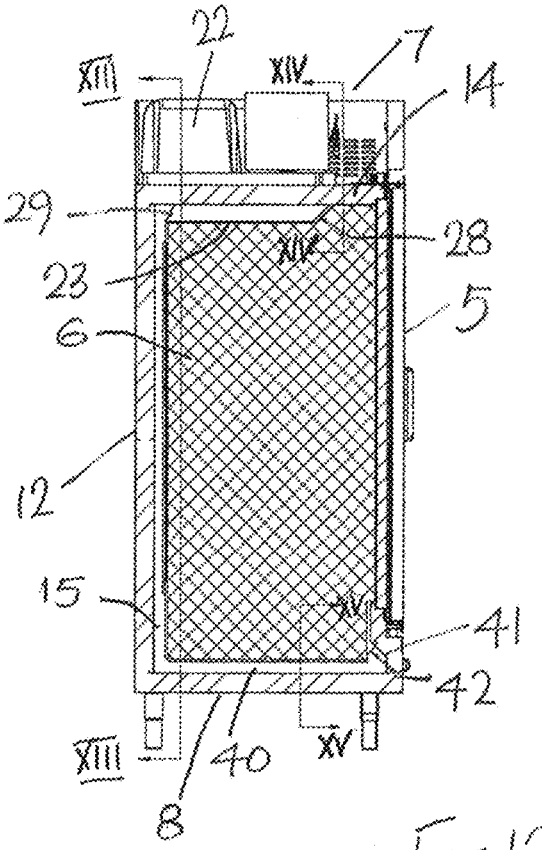
FIG. 12 is a side sectional elevational view of the refrigerated merchandising cabinet shown in FIG. 9.
Figure 13:
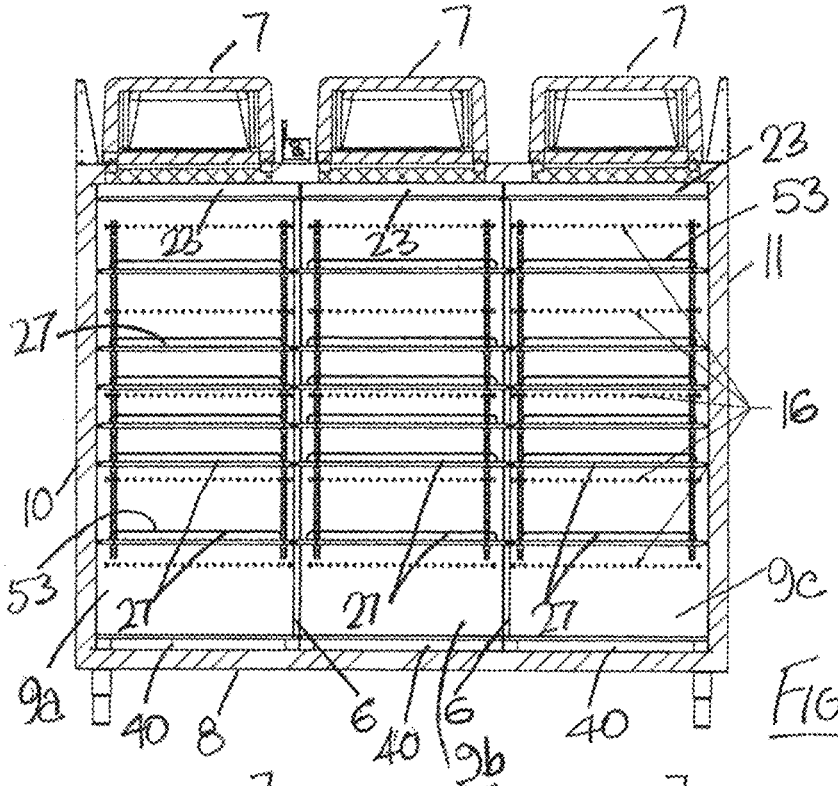
FIG. 13 is a sectional view taken along the line XIII-XIII of FIG. 12.
Figure 14:
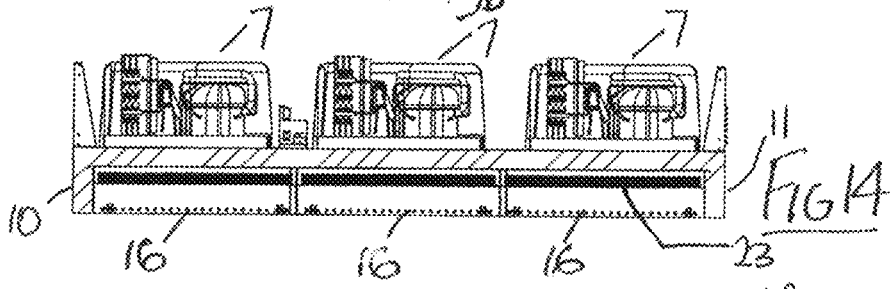
FIG. 14 is a detail sectional view taken along the line XIV-XIV of FIG. 12.
Figure 15:
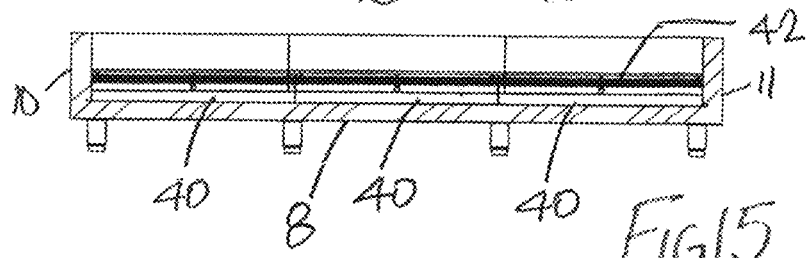
FIG. 15 is a detail sectional view taken along the line XV-XV of FIG. 12.

Referring to the drawings, there is illustrated a refrigerated merchandising cabinet according to the invention, indicated generally by the reference numeral 1. The refrigerated merchandising cabinet 1 comprises an upright insulated housing 2, an interior of which forms a cold storage chamber 3. The housing 2 is open-fronted having a front access opening 4 closed by a plurality of juxtaposed hinged access doors 5. In this case three access doors 5 are provided. An interior of the cold storage chamber 3 is sub-divided into three separate cooling compartments 9*a*, 9*b*, 9*c* by two upstanding internal divider panels 6 (best seen in FIG. 8). Three refrigeration modules 7 are mounted in a row on top of the housing 2 and are operable to circulate chilling air in a controlled manner through the cold storage chamber 3 for chilling or freezing product for sale stored within the cold storage chamber 3. Each refrigeration module 7 is associated with one of the cooling compartments 9*a*, 9*b*, 9*c* and operates independently of the other refrigeration modules 7 in response to sensed climate conditions within the associated cooling compartment 9*a*, 9*b*, 9*c*.

The housing 2 comprises a rectangular base 8 with upstanding side walls comprising end walls 10, 11 and a rear wall 12. A top wall 14 at a top of the side walls 10, 11, 12 is substantially parallel to the base 8. The base 8, side walls 10, 11, 12 and top wall 14 define the cold storage chamber 3 having the front access opening 4.

The two divider panels 6 are mounted within the cold storage chamber 3 substantially parallel to and spaced-apart from the end walls 10, 11 to divide the cold storage chamber 3 into three separate cooling compartments 9*a*, 9*b*, 9*c*. A separate refrigeration module 7 is associated with each cooling compartment 9*a*, 9*b*, 9*c*. Conveniently, the divider panels 6 may comprise a transparent acrylic material.

A cold air duct 15 formed within the rear side wall 12 of the housing 2 has a plurality of vertically spaced-apart cooling air inlet ports 16 for discharging cold air into the cold storage chamber 3 directed towards the access doors 5 at a front of the cold storage chamber 3. The cooling air inlet ports 16 are arranged in a plurality of vertically spaced-apart rows of horizontally spaced-apart cooling air inlet ports 16.

Each refrigeration module 7 sits over an associated opening 17 which extends vertically through the top wall 14 at a top of each cooling compartment 9*a*, 9*b*, 9*c*. A cross piece 18 divides the opening 17 into a front return air inlet 19 and a smaller rear cold air outlet 20 connected to a top of the cold air duct 15. A fan 21 of the refrigeration module 7 draws air from the cold storage chamber 3 through the return air inlet 19 for delivery across an evaporator 22 of the refrigeration module 7. Chilled air from the evaporator 22 is discharged through the cold air outlet 20 into a top of the cold air duct 15. This chilled air travels downwardly through the cold air duct 15 and is discharged into the cold storage chamber 3 through the rows of air outlet ports 16 in cold air streams travelling across the cold storage chamber 3 from an inside face of the back wall 12 towards inside faces of the access doors 5 at a front of the cold storage chamber 3, chilling product mounted on shelves 27 within the cold storage chamber 3. When the cold air streams reach the access doors 5, they travel upwardly along the inside faces of the access doors 5 to a top of the cold storage chamber 3 at a front of the cold storage chamber 3 for extraction through an air outlet manifold 23 forming the cooling air outlet of the cold storage chamber 3.

The air outlet manifold 23 is mounted on an inside face 24 of the top wall 14 of the housing 2. The air outlet manifold 23 has a bottom panel 25 spaced downwardly from the inside face 24 of the top wall 14. The bottom panel 25 extends between the end walls 10, 11 and extends outwardly from an inner face 26 of the rear side wall 12 of the housing 2 towards the access doors 5 and is substantially parallel to the inside face 24 of the top wall 14. A perforated front panel 28 of the air outlet manifold 23 extends downwardly from the inside face 24 of the top wall 14 of the housing 2 to the bottom panel 25 spaced inwardly of the access door 5. The perforated front panel 28 is inclined, being angled outwardly and downwardly of the inside face 24 of the top wall 14 towards the inside face 26 of the rear wall 12. An inclined rear panel 29 of the air outlet manifold 23 is aligned with the associated rear cold air outlet 20 in the top wall 14 and extends between the cold air outlet 20 and an inlet of the cold air duct 15 in the rear side wall of the housing 2 to funnel cold air from the evaporator 22 into the cold air duct 15.

Return air from the cold storage chamber 3 passes through the perforated front panel 28 into the air outlet manifold 23 from where it is delivered through the return air inlet 19 to the fan 21 of the refrigeration module 7.

Figure 1:
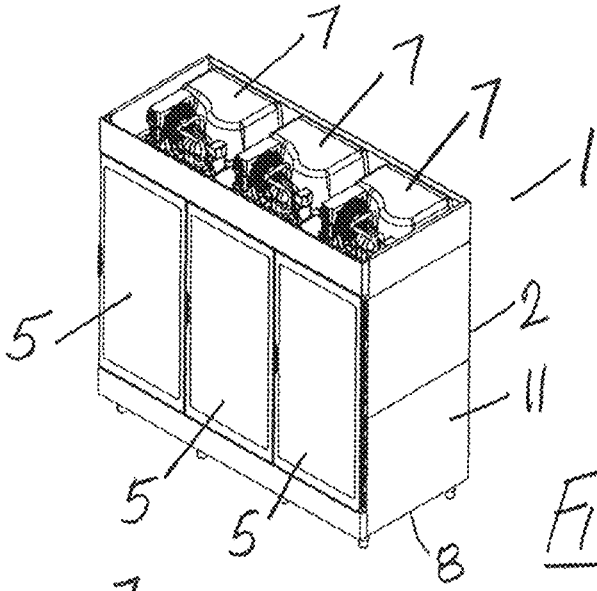
FIG. 1 is a perspective view of a refrigerated merchandising cabinet according to the invention.
Figure 2:
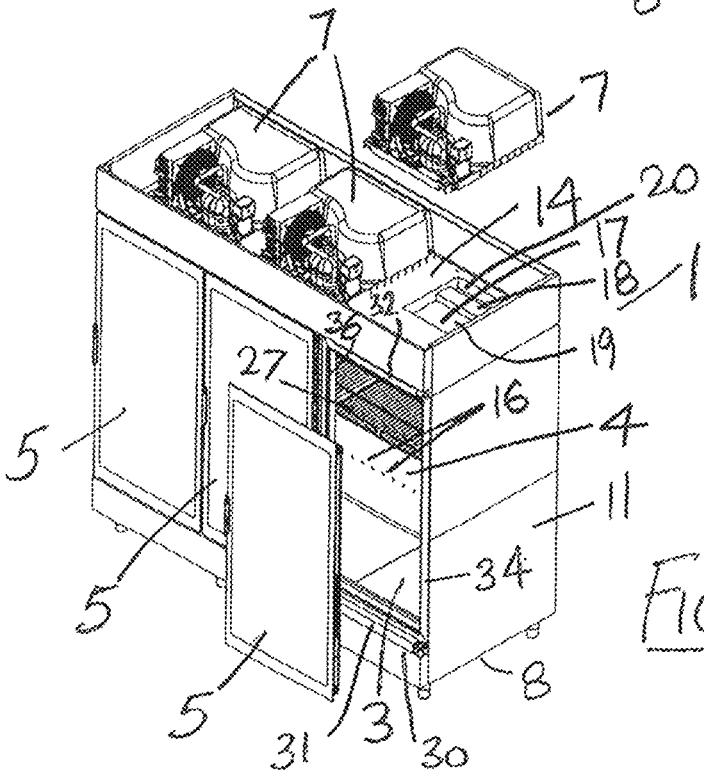
FIG. 2 is an enlarged partially exploded perspective view of the refrigerated merchandising cabinet.
Figure 6:
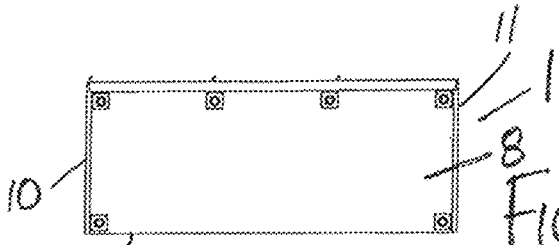
FIG. 6 is an underneath plan view of the refrigerated merchandising cabinet.
Figure 3:
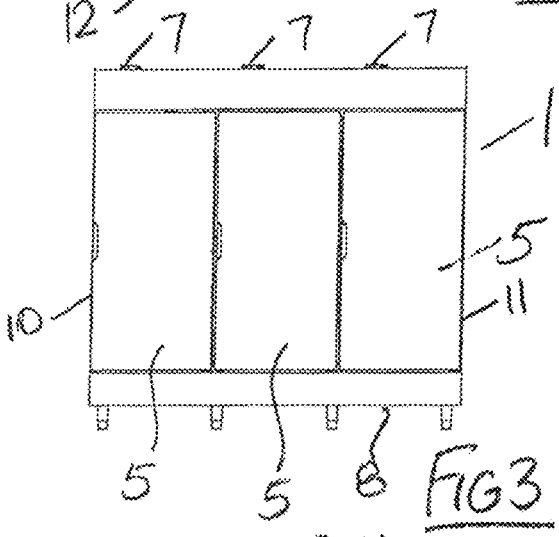
FIG. 3 is a front elevational view of the refrigerated merchandising cabinet
Figure 4:
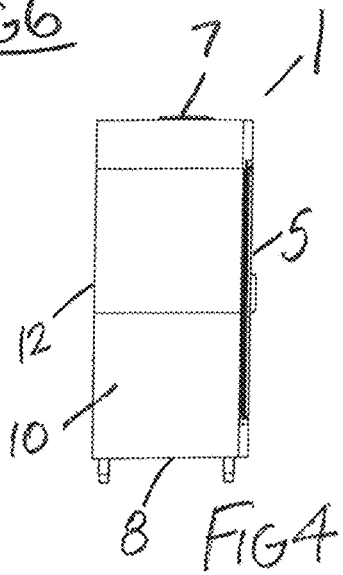
FIG. 4 is a side elevational view of the refrigerated merchandising cabinet.
Figure 5:
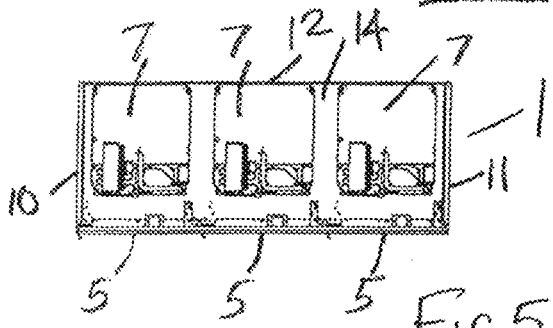
FIG. 5 is a plan view of the refrigerated merchandising cabinet.
Figure 7:
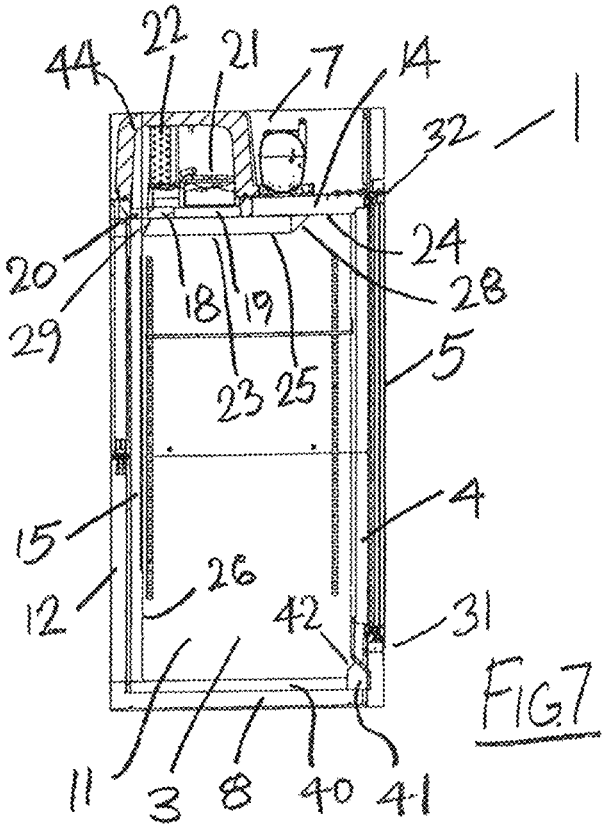
FIG. 7 a side sectional elevational view of the refrigerated merchandising cabinet.

Referring in particular to FIG. 7, the cold air duct 15 communicates through a cold air transfer duct 40 in the base with an air distribution manifold 41 mounted at a front of the base 8 and having an outlet 42 to direct air upwardly along inside faces of the access doors 5. Thus, a cold air stream travels upwardly from the manifold 41 at the base 8 along inside faces of the access doors 5, forming an air curtain which maintains a warm layer of air against the inside faces of the access doors 5 to prevent frosting of the inside faces of the access doors 5. The still air retained behind each access door 5 reduces the need to heat the door 5. Shelves mounted within the cold storage chamber 3 have front edges which terminate about 50 mm-75 mm inwardly of an inside face of the access door 5 to leave an air curtain passageway between the shelves and the doors 5 at inside faces of the doors 5.

It will be noted that each refrigeration module 7 has an evaporator 22 which is mounted outside the cold storage chamber 3 and therefore any defrosting of the evaporator 22 does not affect the cold storage chamber 3. The evaporator 22 is mounted within its own insulated housing 44.

In this case three refrigeration modules 7 are mounted on the top wall 14. Each refrigeration module 7 is self-contained and can be readily easily and quickly lifted out and replaced for maintenance purposes if required with little or no interruption to the smooth and continuous operation of the refrigerated merchandising cabinet 1. The refrigerant used in each refrigeration module 7 is R290 refrigerant.

A separate refrigeration module 7 is associated with each of the cooling compartments 9*a*, 9*b*, 9*c*. Each refrigeration module 7 operates independently of the other refrigeration modules 7 in response to the sensed climate conditions within the associated cooling compartment 9*a*, 9*b*, 9*c*. Thus, if one of the access doors 5 is opened, only the associated cooling compartment 9*a*, 9*b*, 9*c* is affected by the inrush of warm air and the air within that cooling compartment 9*a*, 9*b*, 9*c* is chilled by the associated refrigeration module 7.

One or more of the divider panels 6 may be of insulated material. This conveniently allows adjacent cooling compartments 9*a*, 9*b*, 9*c* to be maintained at different temperatures. For example, one cooling compartment 9*a* might be set for chilling product at a temperature in the range of −2 to −5° C. and an adjacent cooling compartment 9*b* could be maintained at a temperature in the order of −20° C. for freezing product therein.

Each access door 5 is hingedly mounted at a front of the housing 2 and comprises triple glazed transparent panels mounted within an outer rectangular support frame. Thus, product stored within the cold storage chamber 3 is clearly visible to customers. The triple glazing in combination with the controlled cooling air flow delivery through the cold storage chamber 3 facilitates minimal frosting of the inside faces of the access doors 5 when they are opened and closed in use.

The access doors 5 are mounted on a door mounting frame 30 at a front of the housing 2. The frame 30 has a horizontal bottom rail 31 and horizontal top rail 32 interconnected at each end by vertical side rails 33, 34. Intermediate mullions 35, 36 extend vertically between the bottom rail 31 and the top rail 32. Each divider panel 6 extends between the rear wall 12 and a mullion 35, 36 and between the base 8 and the top wall 14 to sub-divide the interior of the cold storage chamber 3 into the three separate cooling compartments 9*a*, 9*b*, 9*c*. Each divider panel 6 does not necessarily have to be airtight, so long as it provides a good separation between adjacent cooling compartments 9*a*, 9*b*, 9*c* with minimal air leakage therebetween.

While the refrigerated merchandising cabinet 1 described has three refrigeration modules 7, in other cabinets of the invention two refrigeration modules 7 or more than three refrigeration modules 7 each with an associated cooling compartment 9*a*, 9*b*, 9*c* could be provided as required.

It will be noted that providing a number of smaller compressors as opposed to one large compressor has a number of advantages. Smaller compressors tend to be more efficient. They are also quieter which it will be appreciated is an important consideration when the refrigerated merchandising cabinet is mounted in a public retail outlet.

Mounting each refrigeration module 7 outside the cold storage chamber 3 advantageously means that the evaporator 22 of each refrigeration module 7 is located outside the cold storage chamber 3, so that when the evaporator 22 is on a defrost cycle it does not heat the cold storage chamber 3.

Referring now to FIG. 9 to FIG. 15, there is shown another refrigerated merchandising cabinet according to a second embodiment of the invention, indicated generally by the reference numeral 50. This is largely similar to the refrigerated merchandising cabinet 1 described previously, and like parts are assigned the same reference numerals. Each shelf 27 has a cut-out portion 52 at a front edge to define a cooling air corridor or the air curtain passageway extending vertically along an inner face of the associated access door 5 for through passage of the air stream from the air distribution manifold 41. Each shelf 27 has upstanding product retaining rails 53 at the front edge of the shelf 27 to retain product on the shelf 27 and prevent the product from moving outwardly into the cut-out portion 52.

The terms "comprise" and "include", and any variations thereof required for grammatical reasons, are to be considered as interchangeable and accorded the widest possible interpretation. The invention is not limited to the embodiments hereinbefore described but may be varied in both construction and detail within the scope of the appended claims.

What is claimed is:

1. A refrigerated merchandising cabinet, comprising:

an upright insulated housing forming a cold storage chamber, the housing having a rectangular base with upstanding side walls comprising end walls at each side of the base and a rear wall at a rear of the base, and a top wall at a top of the side walls, the base, side walls and top wall defining the cold storage chamber having a front access opening, the front access opening closed by at least two access doors, each access door having a transparent window for viewing product stored within the storage chamber;

at least two refrigeration modules mounted spaced-apart on top of the top wall, each refrigeration module having a cold air outlet connected to the cold storage chamber and a return air inlet connected to an associated cooling air outlet of the cold storage chamber; and a cold air duct formed within the rear wall of the housing having a plurality of vertically spaced-apart air outlets for discharging cold air into the cold storage chamber directed towards the access doors at the front of the cold storage chamber for subsequent delivery of air up along an inside face of each access door to the cooling air outlets at the top wall of the cold storage chamber, the cold air duct communicating through a cold air transfer duct in the base with an air distribution manifold mounted at a front of the base and having an outlet to direct an airstream upwardly along inside faces of the access doors.

2. The refrigerated merchandising cabinet as claimed in claim 1, wherein at least one upright divider panel is mounted within the cold storage chamber substantially parallel to and spaced-apart from the end walls to divide the cold storage chamber into at least two separate cooling compartments, each cooling compartment having its own refrigeration module mounted at a top of the cooling compartment.

3. The refrigerated merchandising cabinet as claimed in claim 2, wherein each cooling compartment has a separate refrigeration module and associated cold air duct, cold air transfer duct and air distribution manifold.

4. The refrigerated merchandising cabinet as claimed in claim 2, wherein two divider panels are mounted spaced-apart within the cold storage chamber to divide the cold storage chamber into three separate cooling compartments.

5. The refrigerated merchandising cabinet as claimed in claim 2, wherein each refrigeration module operates independently of the other refrigeration modules in response to sensed climate conditions within the associated cooling compartment.

6. The refrigerated merchandising cabinet as claimed in claim 1, wherein each refrigeration module is operable to control the cooling air speed to limit air turbulence at an inside face of the access doors.

7. The refrigerated merchandising cabinet as claimed in claim 1, wherein the air outlets comprise a plurality of vertically spaced-apart rows of horizontally spaced-apart air outlet ports on the rear wall.

8. The refrigerated merchandising cabinet as claimed in claim 1, wherein each cooling air outlet of the cold storage chamber comprises an outlet manifold on an inside face of the top wall of the housing.

9. The refrigerated merchandising cabinet as claimed in claim 8, wherein each manifold has a bottom panel spaced downwardly from the inside face of the top wall, the bottom panel extending between the end walls and extending outwardly from an inner face of the rear side wall of the housing towards the access doors and having a perforated front panel extending downwardly from the inside face of the top wall of the housing to the bottom panel and spaced inwardly of the access door.

10. The refrigerated merchandising cabinet as claimed in claim 9, wherein the perforated front panel is inclined, being angled outwardly and downwardly of the inside face of the top wall.

11. The refrigerated merchandising cabinet as claimed in claim 8, wherein the manifold has an inclined rear panel aligned with the associated rear cold air outlet in the top wall and extending between the cold air outlet and an inlet of the cold air duct in the rear side wall of the housing to funnel cold air from the evaporator into the cold air duct.

12. The refrigerated merchandising cabinet as claimed in claim 2, wherein the divider panel comprises a transparent panel.

13. The refrigerated merchandising cabinet as claimed in claim 2, wherein the divider panel comprises a stiff plastics material.

14. The refrigerated merchandising cabinet as claimed in claim 2, wherein the divider panel is an insulated panel.

15. The refrigerated merchandising cabinet as claimed in claim 2, wherein product display shelves are mounted in each cooling compartment, each shelf having a cut-out portion at a front edge to define a cooling air corridor at an inner face of the associated access door for through passage of the airstream from the air distribution manifold.

* * * * *